United States Patent [19]

Glasser

[11] Patent Number: 4,917,536

[45] Date of Patent: Apr. 17, 1990

[54] FLUID STORAGE SYSTEM

[75] Inventor: Joseph Glasser, Storrs, Conn.

[73] Assignee: Eljen Corporation, Storrs, Conn.

[21] Appl. No.: 304,663

[22] Filed: Jan. 31, 1989

[51] Int. Cl.[4] ..... E02B 11/00

[52] U.S. Cl. ..... 405/45; 405/36; 405/43

[58] Field of Search ..... 405/43, 45, 36, 52, 405/53, 54, 55; 52/169.5, 169.14

[56] References Cited

U.S. PATENT DOCUMENTS

| | | | |
|---|---|---|---|
| 2,161,999 | 6/1939 | Christie et al. | 405/36 X |
| 2,398,828 | 4/1946 | Gray | 405/53 |
| 2,767,801 | 10/1956 | Eads | 405/36 |
| 3,445,322 | 5/1969 | Saiia et al. | 405/45 X |
| 3,704,593 | 12/1972 | St. Clair | 405/55 |
| 4,233,789 | 11/1980 | Dinardo | 405/53 X |
| 4,639,165 | 1/1986 | Flecknoe-Brown | 405/45 |
| 4,733,989 | 3/1988 | Harriett | 405/43 |

*Primary Examiner*—Dennis L. Taylor

*Attorney, Agent, or Firm*—McCormick, Paulding & Huber

[57] ABSTRACT

A modular self-supporting fluid reservoir that can be provided in an excavation and covered with the excavated fill. A stack of plastic core sheets is bundled to form each module.

2 Claims, 2 Drawing Sheets

FLUID STORAGE SYSTEM

This invention relates generally to systems for storing fluids below ground, and deals more particularly with an inexpensive light weight fluid storage system comprising a plurality of generally rectangularly shape modules that can be assembled in an excavation and subsequently covered with readily available fill to provide a subterranean self-supporting cavity suitable for the storage of fluids such as ground water, or such as leachate where the fluid storage system is adapted for use in a subterranean fluid filtering and drainage system of the type shown and described in a co-pending application filed July 22, 1988, and identified by Ser. No. 223,207.

The primary aim of the present invention is to provide a fluid storage or reservoir system that can be conveniently prefabricated and pre-assembled in modular form so as to be readily transported and handled at a job site. Present storm water run-off installations require relatively large diameter concrete or steel pipes that are fed by a series of catch basins designed to channel storm water into such pipes. These pipes generally carry off the storm water either into a retention pond or into an existing stream or the like. The present invention permits a series of modules to be placed along side or on top of one another in an excavation, and the resulting assembly covered with a fluid pervious but earth impervious fabric material, the resulting construction can then be backfilled with the excavated material itself. Alternatively, the storage or reservoir system of the present invention may replace a conventional leach field of the type normally provided downstream of a septic tank distribution box. Such systems generally require 12" or more of crushed stone placed in trenches following which a covering material must be provided before backfilling with the excavating material.

In accordance with the present invention a plurality of identically shaped or at least compatible rectangularly configured modules are pre-fabricated at a convenient location remote from the job site. Each such module has a height h, width w and a length l. Each module includes a plurality of rigid polystyrene core sheets, and each core sheet is formed from an initially flat sheet of stiff plastic material of thickness approximately 1/32 of an inch. Each core sheet is further characterized by a rectangular height h and a width w, corresponding to that of the module, and each core sheet has opposed faces with alternate raised land portions and with surrounding valleys of corresponding configuration to provide an overall thickness (T) for each core sheet that is approximately 25 times that of the thickness (t) of the initially flat sheet material. Fluid pervious non-woven flexible fabric segments of minimal thickness are interposed between the adjacent core sheets in each module and these fabric segments also have a width w and height h. At least one and preferably two bands encircle a stack of such sheets and fabric segments with the core sheets and fabric segments arranged alternatively in the stack so as to provide a stack of length at least $N \times T$ where N equals the number of core sheets and t equals the overall Thickness of one such core sheet. The thickness of the fabric segments is such that it can be ignored.

Turning now to the drawings in greater detail, the present invention calls for a plurality of generally rectangular parallelepiped modules of uniform shape and size, each module having a height h, a width w and a length l. Such a module is illustrated in FIG. 3 and can be seen from that view to be such that a plurality of such modules can be arranged either in side-by-side relation and/or in stacked relationship to occupy an excavation prepared to receive such an assembly of modules. The uppermost module in any such assembly would normally be provided 6" below the surface of the ground as suggested in FIG. 2 and in any event need not be provided at the depths now required for conventional water filled concrete structures of the type currently in use to store water either in a storm drain systems or in septic tank systems generally.

Figure 2:
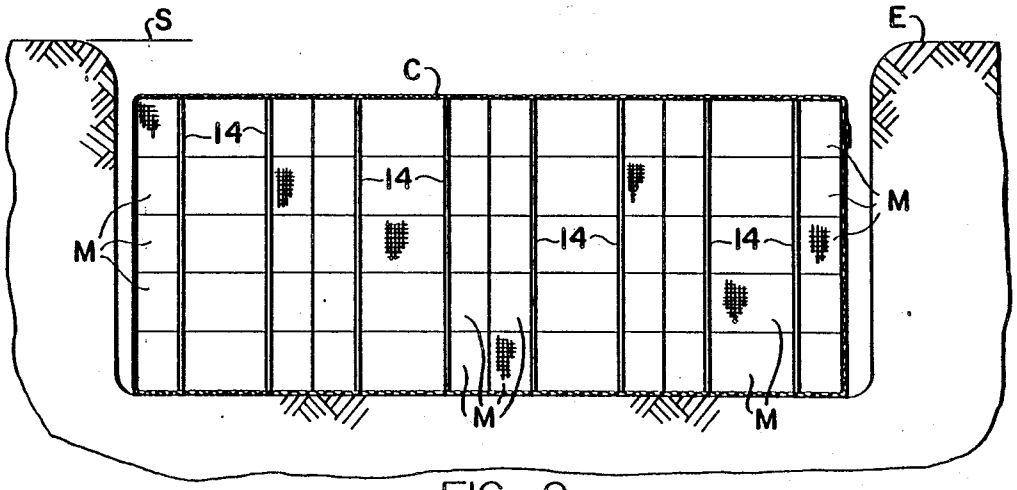
FIG. 2 is a vertical section taken generally through an excavation in which a plurality of modules have been stacked in accordance with the present invention and covered by a fluid pervious/earth impervious cover. This view illustrates the system prior to backfilling of the excavated material, and also omits the associated conduit or pipe connecting the system of the present invention with an existing septic system or with any fluid storage system such as a storm drain or water run-off installation.
Figure 3:
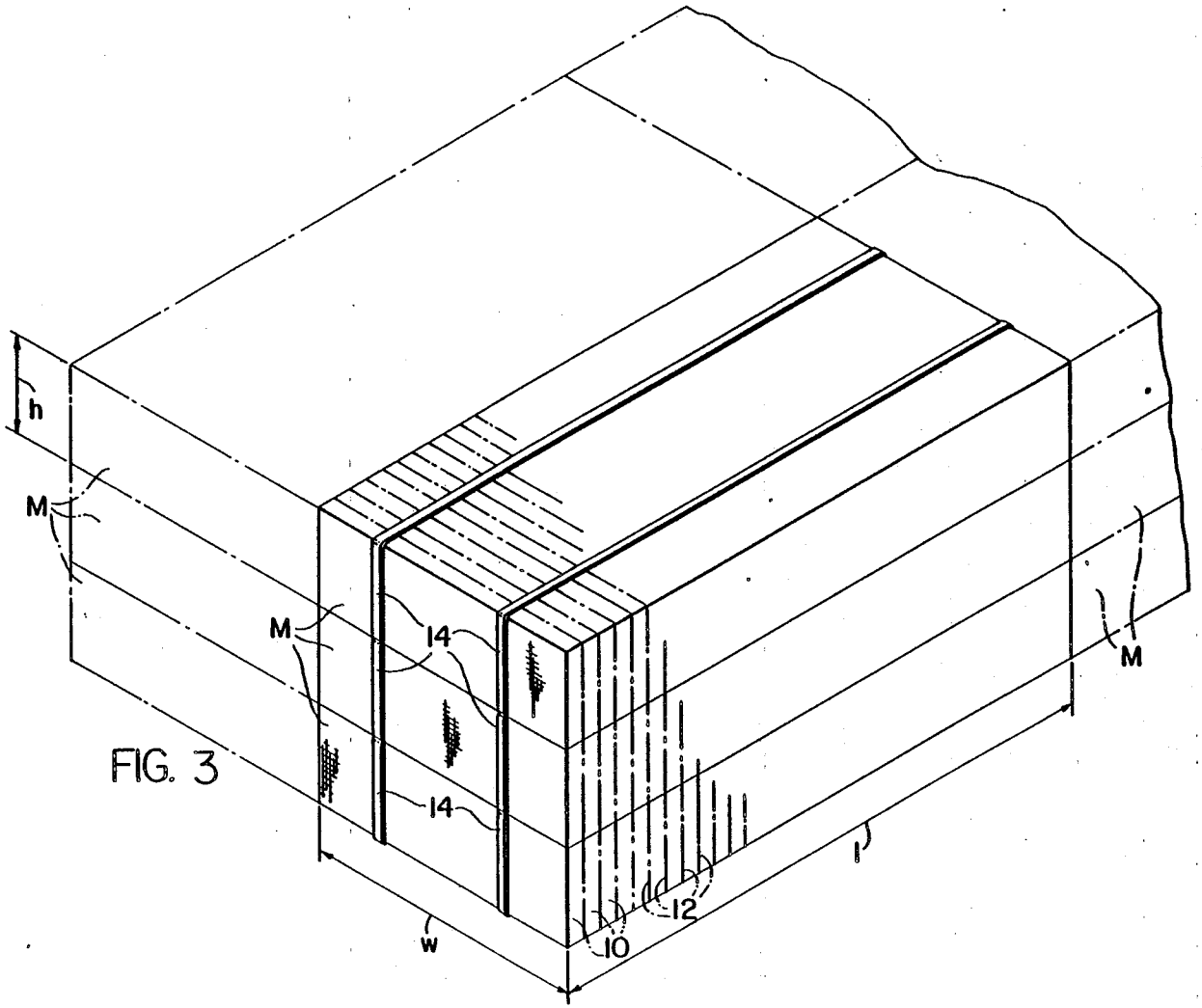
FIG. 3 is a perspective view showing one module in solid lines and adjacent modules in broken lines to illustrate the rectangular configuration for each such module.

FIG. 2 shows modules in stacked configuration provided in an excavation E, and the assembly of modules M,M is preferably covered by a fluid or water pervious material as indicated generally at C. The sheet C is wrapped around the entire assembly of modules prior to backfilling of the excavation. This covering C may comprise a water pervious non-woven flexible fabric material such as that referred to in my issued Patent No. 4,490,072, or equivalent. The geometry of each module is chosen such that the modules can be conveniently fabricated and conveniently transported to a construction site for installation in an assembly such as that of FIGS. 2 and 3. More particularly, the height h is preferably between 6" and 12" the width w is preferably 18", and the length l approximately 36". The 6" height has been found most satisfactory in septic tank leaching field installations whereas the 12" height for each module is somewhat more convenient in handling large quantities of storm water such as suggested in the FIG. 2 excavation.

Turning now to a more detailed description of each such module M, each such module includes a plurality (as for example N) of rigid core sheets 10.10 of identical geometry and each of which is formed from an initially flat sheet of polystyrene material of thickness t. Each core sheet 10 has a rectangular configuration having a height h and width w and after being formed with the raised lands and surrounding valleys as described below also has an overall thickness (T). A plurality of such core sheets can be stacked as suggested in FIG. 1 to define a module M.

Figure 4:
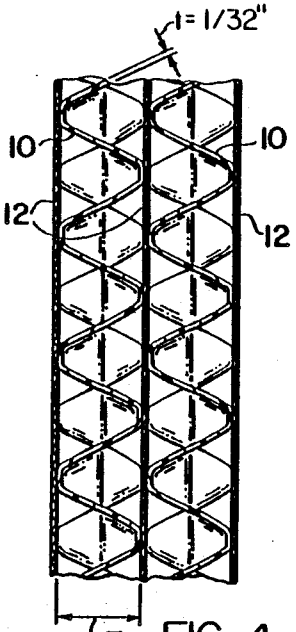
FIG. 4 is a sectional view through two adjacent core sheets and associated water pervious fabric segments illustrating the relative thicknesses (t) of the core sheet material and the overall thickness (T) of a core sheet as provided in the stack of core sheets and unwoven fabric segments in a module such as that illustrated in FIG. 3.
Figure 1:
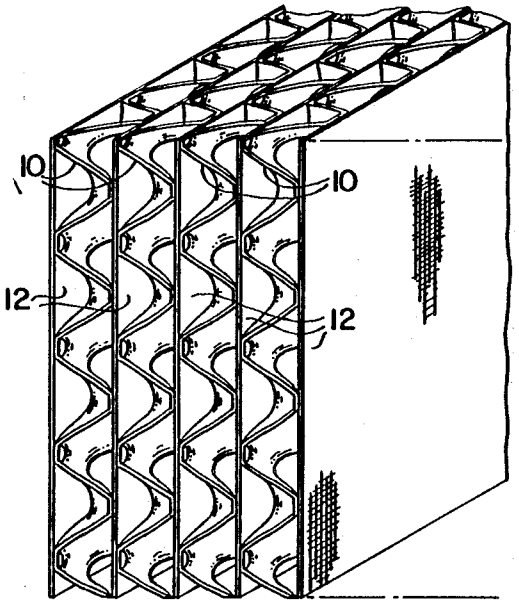
FIG. 1 is a perspective view illustrating one module constructed in accordance with the present invention.

More particularly, these core sheets 10,10 are separated from one another by a fluid pervious non-woven flexible fabric material in the form of individual segments 12,12 as best shown in FIG. 1. As best shown in FIG. 4 the thickness (t) of the core sheet material is on the order of 1/32 of an inch, and the overall thickness (T) of the formed core sheet with opposed lands defined in the opposed faces has a thickness of approximately 25 times that of the thickness (t) of the core sheet material itself. That is, the sheet material is 1/32 of an inch and the overall thickness (T) of the core sheet is on the order of ¾ of an inch. Each core sheet is formed to have valleys and raised lands that are spaced from one another by a distance of approximately the dimension T (¾ of an inch) and these core sheets are preferably formed from a relatively rigid plastic material such as polystyrene. Such material is available from Eljen Corporation, 15 WestWood Raod, Storrs, Conn. 06268. This material has been used for some time in subterranean environments with satisfactory results, and is described in some detail in my issued Patent No. 4,490,072.

As suggested in FIGS. 1 and 4 the alternate core sheet 10 and fabric segments 12 define a stack such that the length of the stack corresponds approximately to N×T (disregarding the thickness of the fabric segments themselves). This assembly or stack is held in place by at least one and preferably two plastic straps, as suggested generally at 14 in FIG. 3, with the result that each module M is a self-contained assembly that can be conveniently handled at the job site in order to define any predetermined volume for the fluid to be handled. The unique design permits the design engineer and/or the contractor a degree of flexibility in such a system not available with prior art subterranean water storage installations generally.

I claim

1. A subterranean fluid storage system comprising a plurality of rectangularly shaped modules of uniform geometry, each module having a height (h) and a width (w) and a length (l), each module including at least two straps encircling said module lengthwise, said straps being spaced from but parallel to one another, each module further including a plurality (N) of rigid core sheets, each core sheet formed from an initially flat rigid thermoplastic material having a thickness (t), each core sheet further characterized by a rectangular height (h) and width (w), each core sheet further including opposed faces with alternate raised land portions and with surrounding valleys of corresponding configuration to provide an overall thickness (T) for each core sheet that is approximately twenty-five times the thickness (t) of the initially flat sheet material, fluid pervious non-woven flexible fabric segments interposed between adjacent core sheets in each module, said core sheets in said fabric segments cooperating to define a laminated stack of length at least N×T, wherein N equals the number of core sheets and T equals the overall thickness of one such core sheet, said fabric segments being relatively thin in comparison to the overall thickness of the core sheets, and said modules being arranged adjacent to one another in a ground excavation, said modules being stacked one on top of another to a height which is in even multiple of the height of each module and wherein additional modules are arranged in side-by-side relationship with said vertically stacked modules, and a fluid pervious fabric material covering said stacked adjacent modules.

2. The system according to claim 1 wherein further modules are arranged in end-to-end relationship with the said stacked modules to provide an elongated fluid storage reservoir designed to gradually recharge the ground water in the surrounding area.

* * * * *